US006122881A

United States Patent [19]

Aubertot

[11] Patent Number: 6,122,881

[45] Date of Patent: Sep. 26, 2000

[54] LENGTHWISE EXTRUSION OF FACING BRICKS TO CREATE INTERLOCKING PROFILES

[76] Inventor: Christophe Aubertot, Ceric Inc. Linpro Ctr. 1, 7125 W. Jefferson Ave., #145, Lakewood, Colo. 80235

[21] Appl. No.: 09/167,974

[22] Filed: Oct. 8, 1998

[51] Int. Cl.[7] ..... E04C 2/04

[52] U.S. Cl. ..... 52/604; 52/596; 52/603; 52/605

[58] Field of Search ..... 52/603, 604, 605, 52/606, 596

[56] References Cited

U.S. PATENT DOCUMENTS

| | | | |
|---|---|---|---|
| 2,021,133 | 11/1935 | Munson | 52/604 |
| 2,736,188 | 2/1956 | Wilhelm | 52/606 |
| 4,698,949 | 10/1987 | Dietrich | 52/415 |
| 4,802,318 | 2/1989 | Snitovski | 52/309.12 |
| 5,715,635 | 2/1998 | Sherwood | 52/286 |

*Primary Examiner*—Christopher T. Kent
*Assistant Examiner*—Jennifer I. Thissell
*Attorney, Agent, or Firm*—Patent & Trademark Services; Thomas Zack; Joseph H. McGlynn

[57] ABSTRACT

Extruded bricks that have two opposite facing sides one with a depending tongue and the one with a groove base surface. These tongue and groove sides are interconnected by adjacent vertically disposed brick sides. A hollow interior core may extend the length of each brick and an extrusion created longitudinal lower edge groove extends along the bottom edge length of each brick opposite the brick's front face. Ties, mortar or other bonding materials may engage these longitudinal edge grooves in two adjacent engaged bricks to hold vertically disposed courses of bricks to an existing vertical supporting stud of a building. A smaller sub groove or indentation within the brick's top groove may be used to apply mortar to provide additional bonding between two layered courses of such bricks.

4 Claims, 1 Drawing Sheet

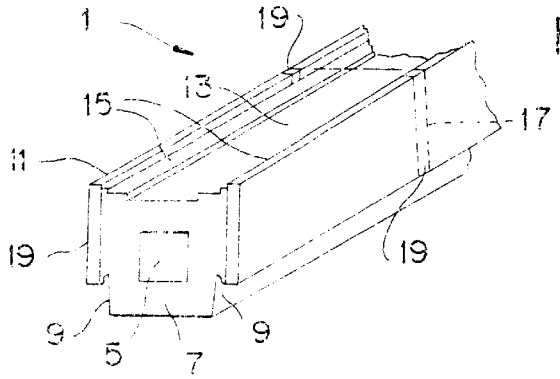
FIG. 1
FIG. 2
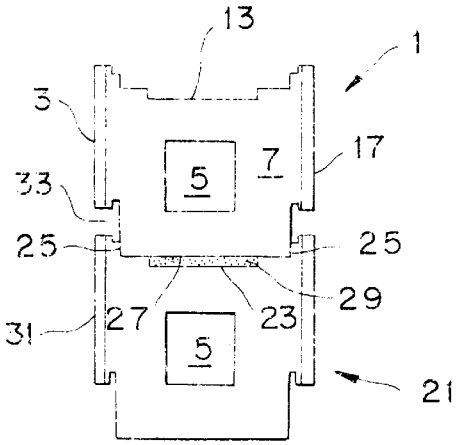
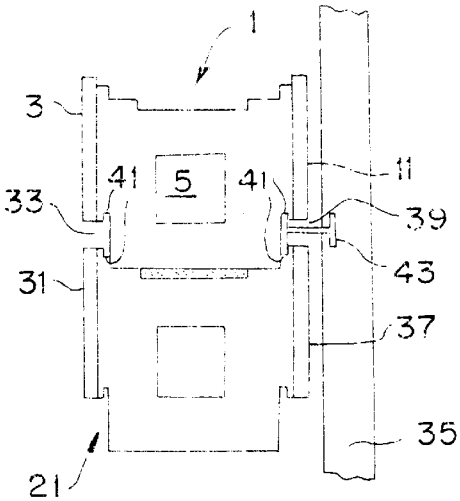
FIG. 3
FIG. 4
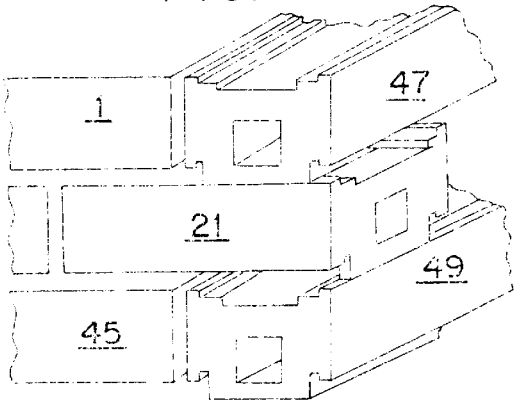
FIG. 5
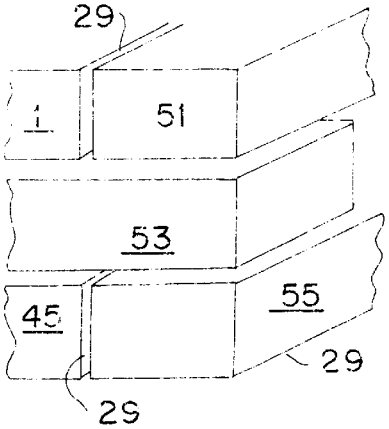

LENGTHWISE EXTRUSION OF FACING BRICKS TO CREATE INTERLOCKING PROFILES

BACKGROUND OF THE INVENTION

One commonly used method to make clay bricks extrudes the clay material crosswise in a continuous process where the length of the individual bricks and their width are the two dimensions formed by the extruder die. In this process to facilitate the drying and firing process of the clay material and to minimize the weight of the individual bricks, up to about 25 percent of the brick's volume may consist of holes that form an interior void. This formed void is typically located through the bed faces of the brick such that a vertically laid wall conceals the void from view. The individual bricks are formed by cutting the extruded clay material with wires spaced at a distance equal to the desired brick height before being sent to the kiln for baking. Also before being baked, the exposed facing surfaces of the bricks and their end surfaces may be textured or colored as desired.

Once formed, the individual bricks have for centuries been assembled by using traditional masonry techniques that employ a bricklayer to lay courses of brick one over the other. With such techniques a relatively thick mortar joint (about ⅜ to ½ of an inch) is used between the brick's joints. This process is both labor intensive and has utilized the same types of tools , such as, trowels, plumb bobs, levels and cords, or string lines for many years. As a consequence, the overall process results in low productivity over time and is also wasteful of the amount mortar used. For example, commonly the applied mortar falls to the ground on both sides of the vertical brick wall and is wasted. And when bricks with voids (cores) are used to build the wall, an appreciable amount of mortar ends up in the voids as the bricks are laid side-by-side in different vertical courses.

The present invention relates to a new process that extrudes bricks lengthwise rather than crosswise to allow for the forming of interlocking profiles that will ease the laying of the bricks and also to have voids where the mortar cannot fall. By doing so the amount of mortar used is reduced all as will be described hereafter.

DESCRIPTION OF THE PRIOR ART

Bricks and other building material that have interlocking surface elements are known. For example, in the Harvey invention (U.S. Pat. No. 3,385,182) metallic load bearing planks used to form a horizontally disposed platform have female interconnecting means along one of the longitudinal edges and male interconnecting means along its remaining longitudinal edge.

The Martin patent (U.S. Pat. No. 3,680,277) discloses an arrangement for connecting concrete or clay bricks having dovetail grooves when the members are positioned in end to end relationship. A hollow key members is resilient or flexible and is collapsed to fit within the mating dovetail grooves of the members to interlock them together.

In U.S. Pat. No. 3,815,311 to Nisula et al. the modular building blocks are made of extruded material, like aluminum, have metal snap interlocking means.

The Calvin reference (U.S. Pat. No. 3,936,987) discloses an interlocking brick or building block wall having two separated cores with insulating material and grooved ends used with wedge elements or keys to interlock adjacent blocks in each course.

With the Amaral reference (U.S. Pat. No. 4,258,522) interlocking sides, tops and bottom, with or without adhesive non-mortar materials, are used with construction blocks.

The Malachowski reference (U.S. Pat. No. 4,542,614) discloses hollow structural members with interlocked spline and recesses components.

The building panel module of Phillips (U.S. Pat. No. 4,928,468) uses spaced inner and outer wall surfaces of metallic sheet construction with overlapping interior baffles.

In the Mercier reference (U.S. Pat. No. 5,490,362) a hollow block system is disclosed having mating interconnecting elements extending transversely in rows and slidable in each other upon transversal displacement.

The present invention relates to a process of making and using building blocks, like clay bricks, wherein extruded sections each having a front three-dimensional facing imprint of the block have hollow lengthwise cores and abutting facing inter lockable top and bottom edges with a rear edge groove extending the length of the section all as more fully set forth in this specification.

SUMMARY OF THE INVENTION

This invention relates to extruded building blocks sections that have two opposite facing base edges that interconnect with adjacent vertically disposed sections, a hollow core extending the length of each section, and an extrusion created longitudinal groove extending along the back of the section. Ties, mortar or other bonding materials may engage the longitudinal groove to hold vertically disposed courses of building blocks to the existing vertical supporting studs of a building.

It is the primary object of the present invention to provide for improved extruded building block sections.

Another object is to provide for such sections wherein a hollow core extends the length of the section and a rear longitudinal groove extends along the back surface edge of the section to assist in retaining the section to existing vertically disposed supports.

These and other objects and advantages of the present invention will become apparent to readers from a consideration of the ensuing description and the accompanying drawings.

BRIEF DESCRIPTION OF THE DRAWINGS

FIG. 1 is a perspective view of the invention's preferred embodiment.

FIG. 2 is a side view of the FIG. 1 preferred embodiment showing two vertically disposed sections one-on top of the other.

FIG. 3 is a side view, like FIG. 2, showing the vertically disposed sections tied to an existing stud of a building.

FIG. 4 is perspective view of the joining corner for two sections of building blocks like those shown in FIGS. 1–3.

FIG. 5 is a perspective view like FIG. 4 with several different sections of brick substituted for the corner section bricks having exposed holed visible ends

DESCRIPTION OF THE PREFERRED EMBODIMENT

FIG. 1 is a perspective view of the invention's preferred embodiment. The extruded clay section 1 may consist of a building block having a front facing vertically disposed surface 3 that resembles a conventional building block surface, such as the shown brick surface. Extending the total length of the section 1 is an interior hollow core cavity 5 with two opened opposite ends formed in the extrusion process by four joining wall surfaces that the extrusion die (not shown) forms during the process. This core cavity, like the hollow core holes in conventional bricks, not only reduces the weight of the section 1 but facilitates the drying and firing process of the clay material used to construct the section. However, since the cavity extends the longitudinal length of the section and is closed on two of its sides, and its top and bottom, any mortar or other bonding material used on the exterior surface of the section will not enter into the opened ends of the cavity 5.

The lower surface of the section 1 is mostly composed of a lower depending tongue member 7 which extends the total length of the section in the same direction as the parallel internal cavity 5. Two outer lower side grooves 9 on each side of the tongue member 7 run substantially the total length of the tongue along the length of the section. These opposite side grooves define the height of the tongue member. The rear facing planar surface 11, opposite and generally parallel to the front facing surface 3, is similar to the surface 3 but need not be textured or colored since it is hidden from view and faces towards the existing building or vertical support structure used to provide additional vertical support when two or more sections 1 are disposed on top of each other.

The top surface 13, opposite the tongued bottom 7, is an indented groove running the length of the section and extending in the same direction (i.e., parallel to) the tongue 7 and internal cavity 5. Two raised opposite side walls 15 extruded into the top of section act to form and define this upper groove. The dotted line 17 indicates a possible wire cutting location line through the extruded clay used to form and define the section 1. If desired, the then cut section may have joints cut away by a shaving tool at the section's four different edge corners 19. These corner cut always extend only partially into the section to where the top walls 15 and lower grooves 9 end. The indentations formed by the edge corner cut always make the section appear more like an individual brick and also provide a receptacle for any mortar that may be use to assist in holding adjacent sections together.

FIG. 2 is a side view of the FIG. 1 preferred embodiment showing two vertically disposed sections one-on top of the other. The upper section 1 is the same as in FIG. 1 and the lower section 21 is substantially identical to it. An upper groove 23 in section 21 is like upper groove 13 in section 1. The lower tongue member 7 of section 1 sits over the groove 23 and extends past it on both sides until it engages the side walls 25. These side walls 25 are like walls 15 and extend the length of the section 21.

A small indentation 27 in the floor of the groove 23 provides a cavity that runs the length of the section which can be used for receiving mortar or other bonding media 29 to bond the upper section 1 with its lower tongued member 7 to the groove in the section 21. Thus, as seen the adjacent tongue and groove interconnects between the vertically aligned sections 1 and 21 complement each other in size and shape. The exposed view able facing generally vertical surfaces 3 (reversed from FIG. 1 in this second figure) and 31 have an additional longitudinal groove or gap 33 between them which also may be filled with mortar or other bonding material to resemble mortar in appearance.

FIG. 3 is a side view like FIG. 2 showing the two vertically disposed sections tied to an existing stud 35 forming part of a building's vertical support. The rear facing surface edges 11 and 37 of sections 1 and 21, respectively, have a gap or groove 39 extending along the lengths of the adjacent sections similar in side and orientation to front groove 33. These two opposite facing grooves may have two indented inner facing lips 41 used to form an enlarged cavity indentation that can receive the enlarged end of a double T-shaped tie 43 member. One end of the member 43 rests into the two lips 41 formed in the back surfaces of the sections while the other end of the member is embedded into the material, e.g., wood or other material, forming the stud 35. Mortar (29) between the sections 1 and 21 may or may not be present in this type of tie retaining support arrangement.

FIG. 4 is perspective view of the joining corner for two sections of building blocks like those shown in FIGS. 1–3. Normally several vertically disposed one-on-top of the other sections 1, 21, and 45 can be used to construct a vertical wall. However, when two such walls join at a right angle with each other to form a corner (see added sections , 47 and 49 at right angles to the three other sections) the exposed internal cavity end holes 5 for sections 21, 47 and 49 will be visible.

One solution is to have two different kinds of special additional corner bricks. The first of these special types of corner bricks, called type a, has a groove but not tongue so that it can interlock with the regular tongued and grooved brick of the wall, but have no tongue so as not to interfere with the other second special type of brick, called type b. This second type of special corner brick, type b, have neither tongue nor groove nor internal closed longitudinal cavity. Type a brick is still extruded lengthwise with a groove and internal cavity but without a depending tongue.

From outward appearances, the type b special corner brick with its lack of a groove, tongue or internal cavity, appears to be like a traditional conventional solid brick. However, for the two special types of corner bricks to match together and have their joints filled up with mortar, the lack of a tongue in type a is important to insure a uniform joint.

FIG. 5 is the FIG. 4 perspective view with three substituted end bricks used in place of the three brick end sections 21, 47 and 49. These new substituted corner bricks 51. 53 and 55 were extruded in the traditional way with the texture and color of the joining sections remaining brick sections (1 and 45) to have the same outer facing surface (e.g., surface 3 of section 1) to cover the holed ends of adjacent sections. Mortar 29 can be placed between any of the exposed vertical or horizontal joints to aid in holding the brick sections together and to achieve a traditional appearance.

It should be clear that the tongue and groove mating surfaces of the adjoining vertical bricks requires less mortar than conventional flat faced bricks while providing a strong vertical support without the use of excessive labor efforts or the use of excessive amounts of mortar. Also, other types of building blocks, such as cinder blocks, could also be employed using the same extrusion process to building the individual block sections.

Although the preferred embodiment of the present invention and the method of using the same has been described in the foregoing specification with considerable details, it is to be understood that modifications may be made to the invention which do not exceed the scope of the appended claims and modified forms of the present invention done by others skilled in the art to which the invention pertains will be considered infringements of this invention when those modified forms fall within the claimed scope of this invention.

What I claim as my invention is:

1. A building block system comprising:

first and second extruded interlocking building blocks, each of said first and second blocks having a length and being substantially identical to each other in appearance;

said first and second building blocks each having a front facing surface, a back surface opposite said front facing surface, a top surface and a bottom surface opposite said top surface;

an elongated tongue member extending substantially the total length of each of said first and second building blocks along the bottom surface of each of said blocks;

an indented top surface groove located on the top surfaces of said first and second building blocks, the top groove of said first building block being sized and shaped to complementarily receive the elongated tongue members of said second building block when placed therein;

said indented top surface of second building block being sized and shaped to complementarily receive the elongated tongue members of said first building block when placed therein;

each of said first and second building blocks having a mortar receiving grooves indented within their respective top surfaces grooves, said mortar receiving grooves extending in the same direction as the top groove of the respective block;

an inner cavity in said first and second building blocks extending the length of said blocks in the same direction as said tongue and groove in each block.

2. The building block system as claimed in claim 1, wherein the back surface of said first and second building blocks each have a grooved edge extending the length of the block that abuts the grooved edge of the other block when received together in a tongue and groove manner to form an opened cavity along the sides of the blocks.

3. The building block system as claimed in claim 2, also including a tie element adapted to fit within an opened cavity formed along the sides of the first and second blocks by said grooved edge and the adjacent block to hold said grooved edge block and an adjacent block to an existing building vertical support.

4. The building block system as claimed in claim 3, also including an additional end capping block having no visible internal cavity adapted to cap and hide from view any exposed inner cavity ends of said first or second building blocks.

* * * * *